US010405620B1

(12) United States Patent
Quinn

(10) Patent No.: US 10,405,620 B1
(45) Date of Patent: Sep. 10, 2019

(54) MULTI-FUNCTION WALKING STICK

(71) Applicant: Terence Michael Quinn, Woodbridge, VA (US)

(72) Inventor: Terence Michael Quinn, Woodbridge, VA (US)

( * ) Notice: Subject to any disclaimer, the term of this patent is extended or adjusted under 35 U.S.C. 154(b) by 0 days.

(21) Appl. No.: 16/038,404

(22) Filed: Jul. 18, 2018

(51) Int. Cl.

| | |
|---|---|
| ***A45B 9/02*** | (2006.01) |
| ***A45B 3/04*** | (2006.01) |
| ***F21L 4/08*** | (2006.01) |
| ***F21V 23/04*** | (2006.01) |
| *F21Y 115/10* | (2016.01) |
| *A45B 9/00* | (2006.01) |

(52) U.S. Cl.
CPC ..... *A45B 9/02* (2013.01); *A45B 3/04* (2013.01); *F21L 4/08* (2013.01); *F21V 23/0414* (2013.01); *A45B 2009/005* (2013.01); *F21Y 2115/10* (2016.08)

(58) Field of Classification Search
CPC ..... A45B 9/02
USPC ..... 135/74
See application file for complete search history.

(56) References Cited

U.S. PATENT DOCUMENTS

| | | | | | |
|---|---|---|---|---|---|
| 1,762,869 | A * | 6/1930 | Kratochwill | A45B 9/02 | 135/66 |
| 1,827,862 | A * | 10/1931 | Weber | A45B 9/02 | 135/66 |
| 4,351,348 | A * | 9/1982 | Axton | A45B 3/00 | 135/66 |
| 4,527,579 | A * | 7/1985 | Knotter | A45B 9/00 | 135/74 |
| 4,887,543 | A * | 12/1989 | Rockhill | A45B 9/06 | 116/201 |
| 5,722,445 | A * | 3/1998 | Hae | A45B 3/00 | 135/65 |
| 6,772,778 | B2 * | 8/2004 | Morosini | A45B 3/02 | 135/65 |
| 7,654,275 | B2 * | 2/2010 | Ewell | A45B 3/00 | 135/66 |
| 8,695,617 | B2 * | 4/2014 | Diamond | A45B 3/02 | 135/66 |
| 9,226,555 | B1 * | 1/2016 | Shyu | A45B 3/04 | |
| 9,277,794 | B2 * | 3/2016 | Moreau | A45B 9/00 | |
| 2009/0166243 | A1 * | 7/2009 | Cetera | A61J 1/03 | 206/528 |
| 2017/0273871 | A1 * | 9/2017 | Glazer | A61J 1/03 | |

* cited by examiner

*Primary Examiner* — Noah Chandler Hawk
(74) *Attorney, Agent, or Firm* — Stuart I. Smith

(57) ABSTRACT

A walking aid is provided for assisting a user during walking on a surface. The walking aid includes a handle configured to be grasped by a hand of the user; a surface contacting portion configured to contact the surface on which the user walks; a shaft having a first end and a second end, the shaft being positioned between the handle at the first end and the surface contacting portion at the second end; and a multi-chamber storage compartment located in the handle, the multi-chamber storage compartment having a plurality of individual chambers that are separated from one another.

20 Claims, 8 Drawing Sheets

MULTI-FUNCTION WALKING STICK

FIELD OF THE INVENTION

The invention is directed to a multi-function device for assisting users who have difficulty walking unassisted. More particularly, the invention is directed to a walking stick that has a plurality of helpful features.

An example of an application for the invention is a cane that has a light and storage compartments for medicine, keys, and identification and/or medical information.

BACKGROUND OF THE INVENTION

More people are living longer lives and many of these people find that in their later years walking requires the assistance of a cane or walking stick. For many people, modern life requires the carrying of medicine, identification, keys, and other things on them at all times. These things can be cumbersome to carry, especially for someone who requires the assistance of a cane or walking stick.

The inventor has created a solution to the above problem by creating a walking stick that fills the needs of many older people by providing storage compartments specifically designed for many of life's daily necessities.

SUMMARY

The invention achieves the benefit of providing a multi-function walking stick that can free the user's hand that is not gripping the walking stick. The user's hand that is not gripping the walking stick can be freed because the various items that must be carried can be stored in the walking stick. In the case of a user that would otherwise carry a purse or satchel, the purse or satchel can be eliminated and thus remove the distraction and/or burden of carrying the purse or satchel or maintaining the purse or satchel on the shoulder of the user. This can provide added safety and protection because the user has a free hand for balance and/or breaking a fall should the user stumble or otherwise fall while using the walking stick.

Particular embodiments of the invention are directed to a walking aid for assisting a user during walking on a surface, the walking aid having a handle configured to be grasped by a hand of the user; a surface contacting portion configured to contact the surface on which the user walks; a shaft having a first end and a second end, the shaft being positioned between the handle at the first end and the surface contacting portion at the second end; and a multi-chamber storage compartment located in the handle, the multi-chamber storage compartment having a plurality of individual chambers that are separated from one another.

Some embodiments include an openable lid that is movable between an open position where access to the individual chambers is available and a closed position when access to the individual chambers is not available. Each of the individual chambers has associated with it a pressing member and an urging member that urges the pressing member toward an interior space of the individual chamber. The pressing member and the urging member are attached to the openable lid such that the pressing member and the urging member move with the openable lid.

In some embodiments, the second end of the shaft has an attachment feature that engages with an attachment element on the surface contacting portion, and the attachment element of the surface contacting portion is attached to the attachment feature of the shaft such that the attachment element is reattachably removable from the shaft by disengaging the attachment element from the attachment feature.

Some embodiments have a folding joint located in the shaft, the folding joint separates a first portion of the shaft from a second portion of the shaft, the folding joint is movable from a walking position in which longitudinal axes of the first and second portions of the shaft are aligned and a folded position in which the longitudinal axes of the first and second portions of the shaft are not aligned.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide a walking aid such as a walking stick that has a plurality of item-specific storage compartments that are configured for specific items.

Figure 1:
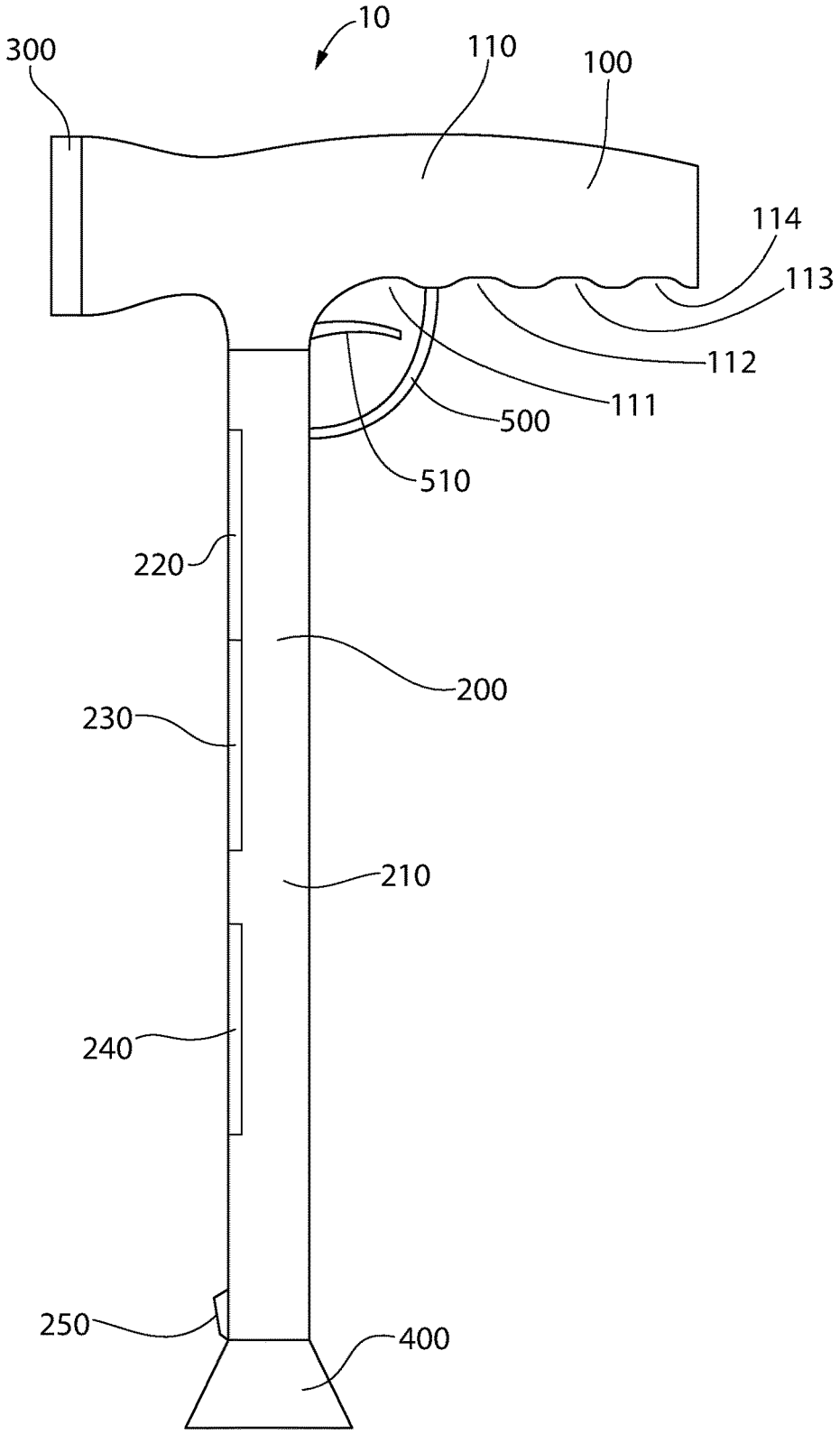
FIG. 1 is a side view of a walking stick in accordance with embodiments of the invention.

FIG. 1 shows an example of a walking stick 10 in accordance with exemplary embodiments of the invention. Stick 10 has three major components, a handle 100, a shaft 200, and a foot 400. In this example, handle 100 is attached to an upper end of shaft 200 and foot 400 is attached to a lower end of shaft 200. In normal use, a user grips a main body 110 of handle 100 with one hand and foot 400 presses against the ground or other surface on which the user is walking. The user can apply very little weight on stick 10 and use it simply to balance themselves, or the user can apply a significant amount of weight on stick 10 through their hand and handle 100 to, for example, reduce the amount of weight supported by one of the user's legs. The user can also apply an amount of weight between the above two examples. In normal use the force transferred from the user to the ground is transferred from the user's hand to handle body 110 and then through shaft 200, through foot 400, and then to the ground. While shaft 200 is shown cylindrical and straight in this example, other examples include a shaft that is curved, angular, or any other shape that transfers force from the handle to the foot. Some examples include a shaft cross-section that is round, oval, polygonal, or any other cross-sectional shape that transfers force from the handle to the foot. Some examples have more than one shaft. In some of the examples with more than one shaft, at least some of the shafts can be parallel to each other.

In the example shown in FIG. 1, handle body 110 has four finger grooves 111, 112, 113, 114 located in a lower area of handle body 110. These finger grooves can correspond, and accept, the index finger, middle finger, ring finger, and little finger of a user's hand when the user grips handle 100. Some embodiments include a trigger guard (discussed below). In some embodiments, a lower side of the trigger guard is shaped to accommodate a user's finger so that the user's finger is located outside of the trigger guard and away from the trigger. This configuration allows the user to grip the trigger guard without actuation the trigger. An example of an appropriate shape for the lower side of the trigger guard is a concave shape that mimics the shape of finger grooves 111, 112, 113, 114. In the example shown, handle 100 has a front section 300 that is located at a distal end of handle body 110. The features that can be included in front section 300 will be discussed below.

Shaft 200 has a shaft body 210 that, in this example, contains a plurality of general storage compartments for storing items such as, for example, money, papers, food, or any other item that can fit in the general storage compartments. This example has three general storage compartment covers 220, 230, 240 that cover the general storage compartments. Other examples can have fewer or more general storage compartments.

Also shown in FIG. 1 is a light 250 that is angled downward and forward to project light onto the ground in front of the user so that the user can better see the ground where they are going to place foot 400. Light 250 can be any form of light source such as, for example, LED, incandescent, florescent, or other light source. Some examples include one or more lights that are resistant to shock, such as an LED light, to avoid the light being broken by the shock that is sometimes transmitted to stick 10 when foot 400 comes into contact with the ground or other object.

FIG. 1 shows some elements of an optional feature that can be used to pick items up using stick 10. A grabber (shown in more detail below) can be operated by a trigger 510 that can be actuated by, for example, the index finger of the user. To help avoid inadvertent actuation of the grabber, trigger 510 can be located inside a trigger guard 500.

Figure 2:
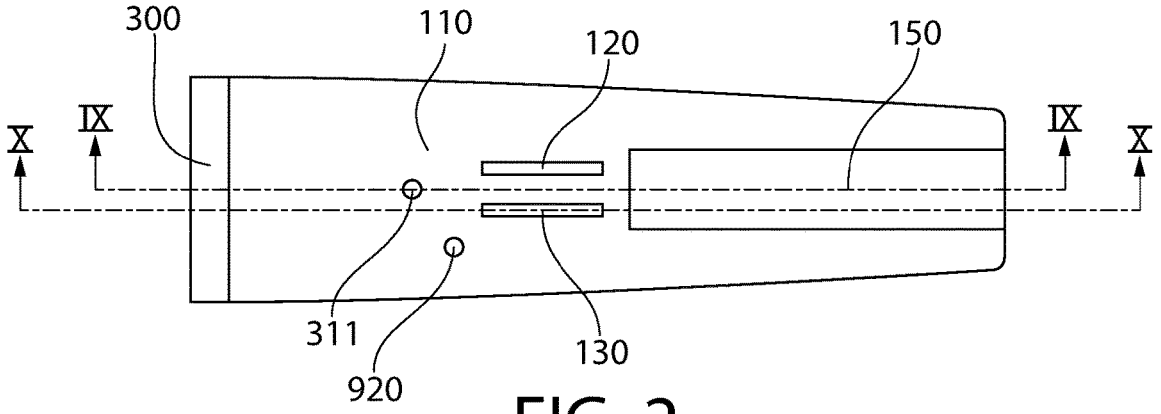
FIG. 2 is a top view of a walking stick in accordance with embodiments of the invention.
Figure 10:
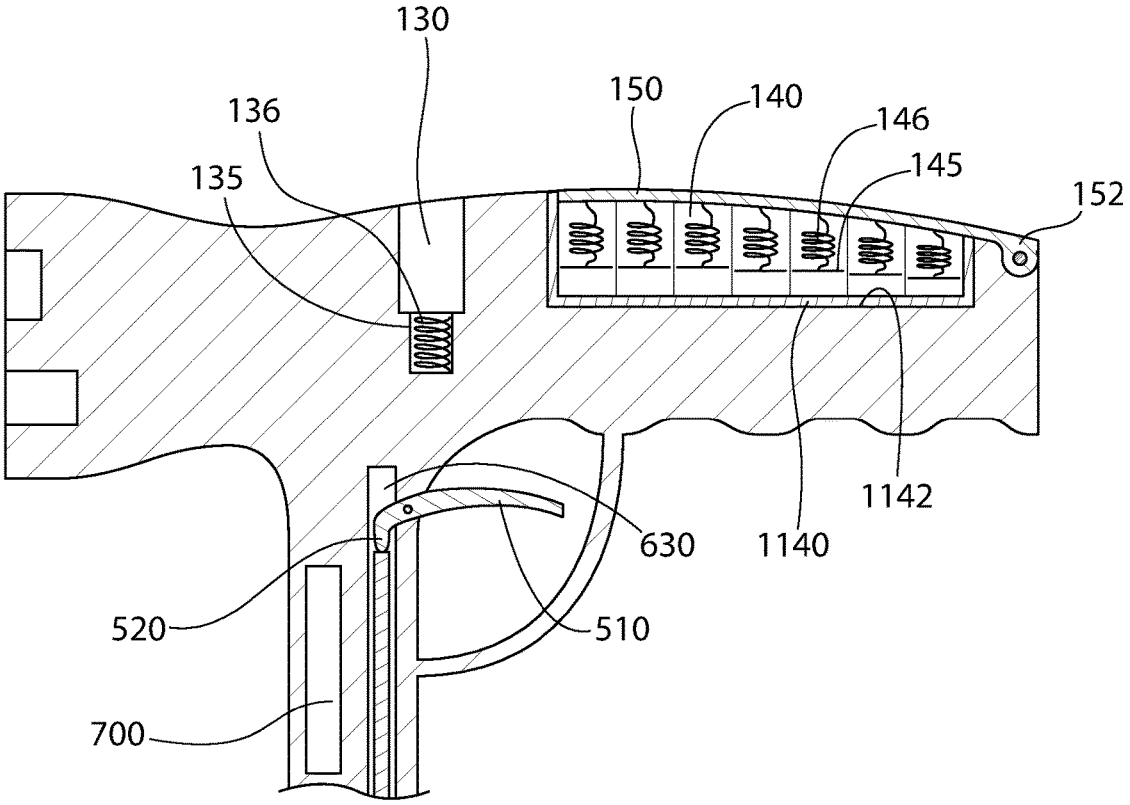
FIG. 10 is a partial sectional view along section line X-X in FIGS. 2 and 3.

FIG. 2 shows an exemplary top view of stick 10. In this example, handle body 110 has two key slots 120, 130. Each key slot 120, 130 is sized to accept a standard house or other key. In some examples, one or both of key slots 120, 130 are sized to receive a standard house key with a slight interference fit so that the key will remain in the slot until the key is positively removed. One or more sides of slots 120, 130 can have a soft plastic, rubber, foam, or other material liner to provide the interference fit while still allowing removal of the key without excessive pressure. FIG. 10 shows a section of key slot 130 and shows a spring 136 in a spring recess 135 below key slot 130. Spring 136 can be attached to the bottom of spring recess 135 to prevent spring 136 from exiting spring recess 135. When a key is inserted into key slot 130 the front portion of the key contacts spring 136 and presses it downward. In some embodiments, the top of the key is flush with the top of handle body 110 when the key is in the storage position. In other embodiments, the top of the key is slightly above or below the top of handle body 110 when the key is in the storage position. A locking or latching mechanism that prevents the key from exiting key slot 130 until the user is ready to remove the key can hold spring 136 in a compressed position until it is released by the user. For example, the locking mechanism can hold spring 136 in a compressed position until the user presses down on the key to move it further into slot 130, at which time the locking mechanism releases spring 136 so that spring 136 pushes the key upward and at least partially out of slot 130. Other examples use a latch or blocking mechanism that at least partially slides over the key to keep the key in key slot 130. Key slot 120 can have a similar or different locking/latching mechanism.

Also shown in FIG. 2 are two light switches. Light switch 311 is, in this example, a mechanical light switch that controls light 310 (explained further with respect to FIG. 9). Light switch 920 is, in this example, an electrical light switch that controls light 900 (explained further with respect to FIG. 9). Although two light switches are shown in this example, fewer or more light switches can be used. For example, one light switch can be used to control all lights on walking stick 10.

FIG. 2 shows an example of storage compartment lid 150 (explained in detail below. Storage compartment lid 150, in this example, covers a plurality of storage compartments that can be, for example, used to store pills or other small items.

Figure 3:
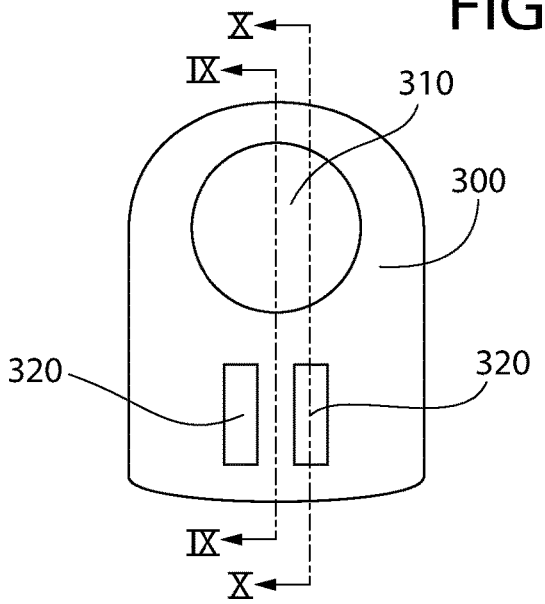
FIG. 3 is a front view of a walking stick in accordance with embodiments of the invention.

FIG. 3 is an example of a front view of walking stick 10. In this example, front section 300 of handle 100 houses a light 310 and two USB ports 320. Light 310 can be any form of light source such as, for example, LED, incandescent, florescent, or other light source. Some examples include one or more lights that are resistant to shock, such as an LED light, to avoid the light being broken by the shock that is sometimes transmitted to stick 10 when foot 400 comes into contact with the ground or other object. USB ports 320 can be connected to a power source such as a battery 700 (FIG. 9) to allow charging of battery 700 and/or to allow charging of an external device such as, for example, a mobile phone by battery 700. One or more of USB ports 320 can also be connected to a speaker or other device in walking stick 10. While USB ports 320 are shown as USB ports, it is noted that other charging/connection ports can also be used such as, for example, mini-USB, micro-USB, phone specific connection ports, etc.

Figure 4:
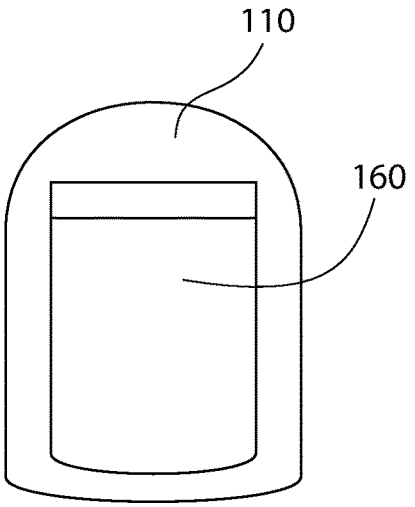
FIG. 4 is a rear view of a walking stick in accordance with embodiments of the invention.

FIG. 4 shows an example of a rear view of walking stick 10. In this example, a back face 160 of handle 100 is shown. In some examples, back face 160 is part of storage compartment lid 150 (explained in more detail below).

Figure 5:
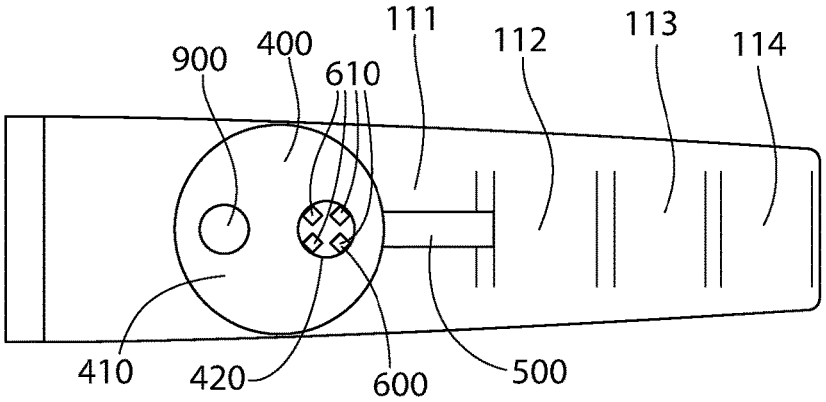
FIG. 5 is a bottom view of a walking stick in accordance with embodiments of the invention.

FIG. 5 shows an example of a bottom view of walking stick 10. In this example, finger grooves 111, 112, 113, 114 and trigger guard 500 are shown. Also shown are light 900, which is controlled in this example by light switch 920. This bottom view shows a grabber 600 that has four fingers 610 that are housed in a hole 420 when grabber 600 is in the retracted position. Further detail regarding grabber 600 will be given in relation to FIG. 8, which shows grabber 600 in an extended position.

Figure 6:
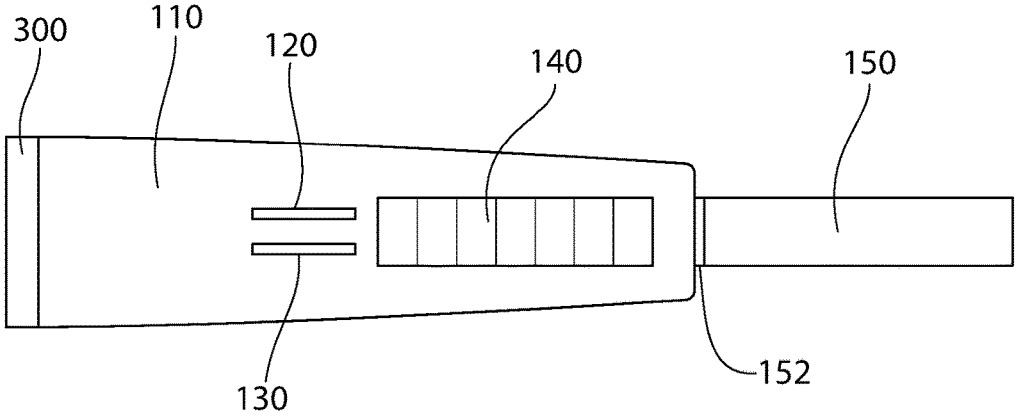
FIG. 6 is an example of a top view of a walking stick in accordance with embodiments of the invention.
Figure 7:
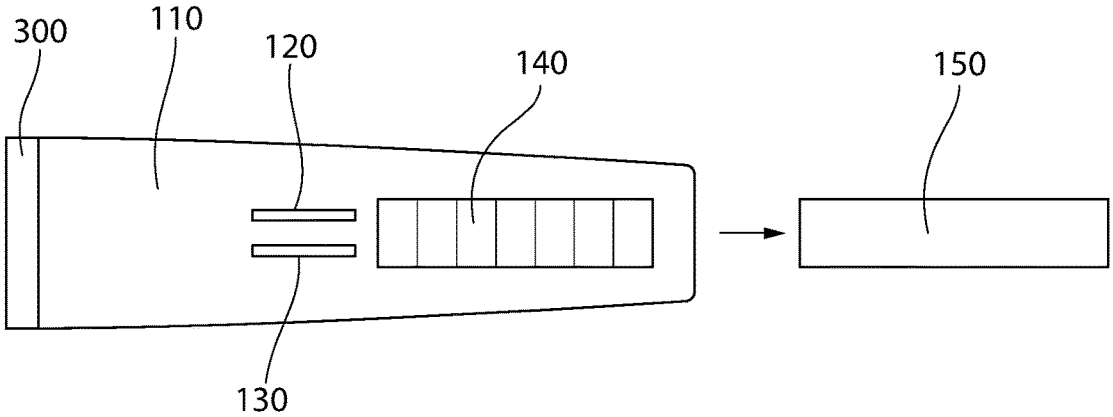
FIG. 7 is an example of a top view of a walking stick in accordance with embodiments of the invention.

FIG. 6 shows an example of a storage compartment 140 that is covered by storage compartment lid 150. In this example, storage compartment 140 includes seven individual storage compartments that correspond to the seven days of a calendar week. The individual storage compartments can be used to hold pills or other medicine for the user. In this example, storage compartment lid 150 is hinged at hinge 152 (see FIG. 9). Storage compartment lid 150 pivots around hinge 152 to an open position to allow access to the individual storage compartments. FIG. 7 shows another example of storage compartment lid 150. In this example, storage compartment lid 150 slides rearward to reveal the individual storage compartments. While two examples of storage compartment lids are shown, other types of storage compartment lids can also be used.

Figure 8:
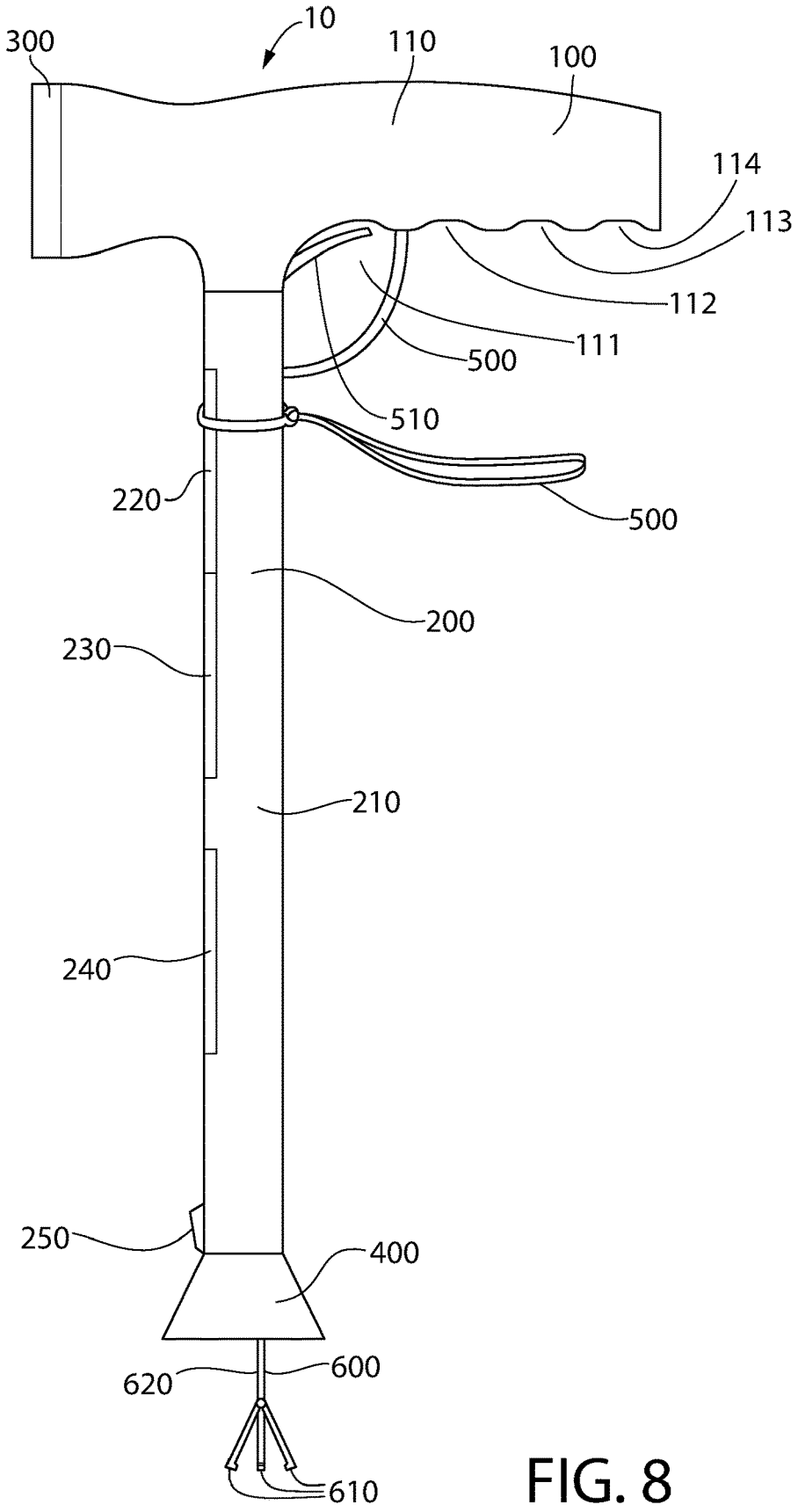
FIG. 8 is a side view of a walking stick in accordance with embodiments of the invention.

FIG. 8 is a side view of an example of walking stick 10 with grabber 600 in an extended position. In this position, trigger 510 has been moved upward by a finger of the user, which pushes down on a grabber shaft 620 with a contact member 520. Grabber shaft 620, which is contained in a passage 630 (see FIG. 9), in turn, pushes grabber fingers 610 out of the bottom of foot 400. In this example, fingers 610 are sprung away from each other by springs, material memory, or other mechanisms to separate fingers 610 to an open configuration (as shown in FIG. 8). When trigger 510 is released by the user, a spring or other urging member (not shown) pulls grabber shaft 620 and grabber fingers 610 upward in the direction of back into foot 400. Grabber fingers 610 are then pushed toward each other by contact with hole 420 in foot 400, which causes a gripping force on the object being grabbed.

FIG. 8 shows a strap 500 attached to body 210 of shaft 200. Strap 500 can be used to hang walking stick 10 for storage or carrying.

Figure 9:
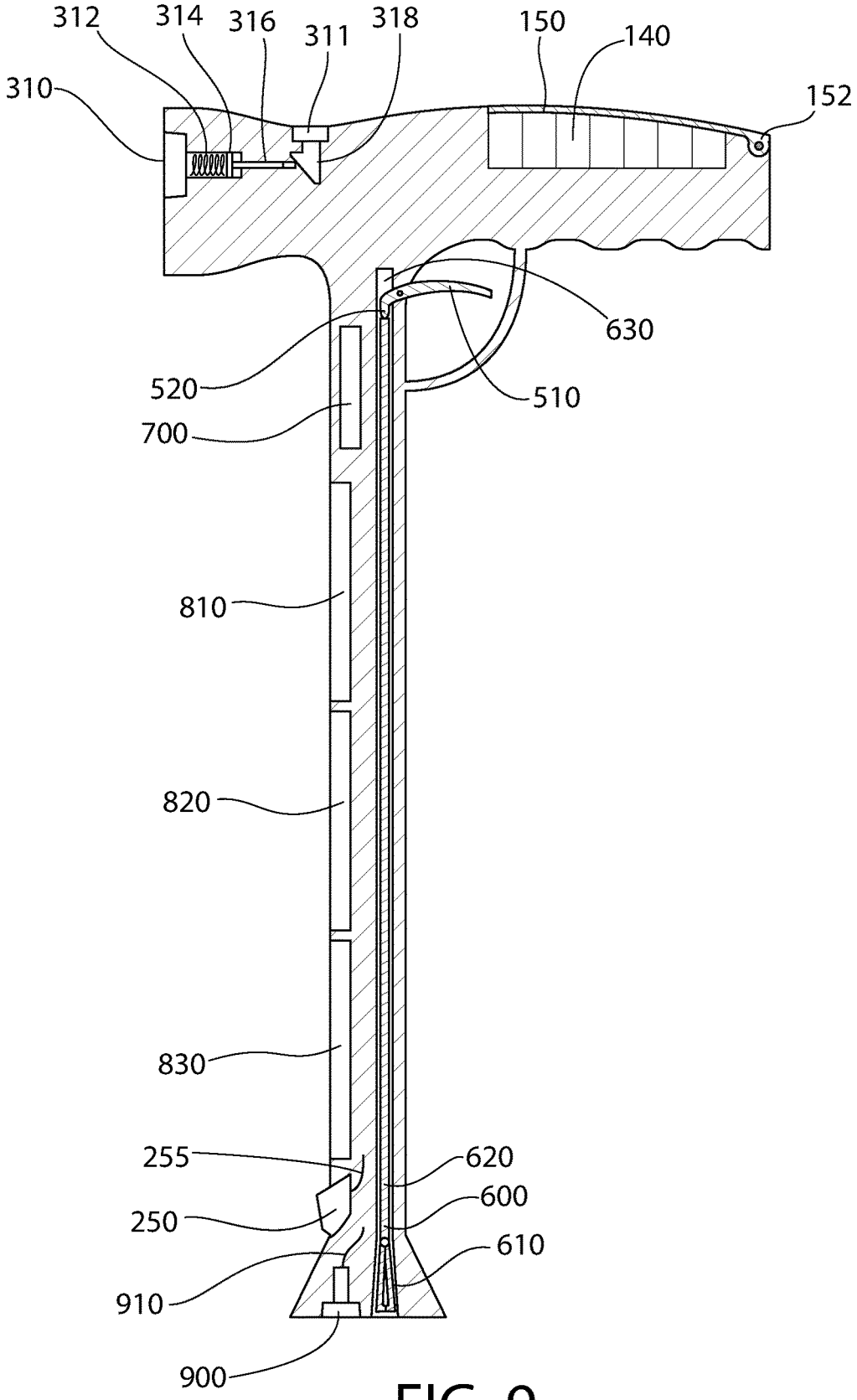
FIG. 9 is a sectional view along section line IX-IX in FIGS. 2 and 3.

FIG. 9 is a sectional view along section line IX-IX in FIGS. 2 and 3. Light 310 is shown as having a mechanical switching mechanism that includes light switch 311 pushing an angled member 318 that interacts with a rod 316. When light switch 311 is pressed downward, rod 316 is moved to the left in the Figure (against a spring 312 that is captured in a recess 314) and creates an electrical contact that provides power to light 310. Other switching mechanisms, including a simple push button electrical connection can be used. Light 250 is shown having an electrical lead 255 that leads to light switch 920 or some other light switch (not shown). Electrical lead 255 transmits power to light 250 to energize light 250. Light 900 is shown having an electrical lead 910 that leads to light switch 920. Electrical lead 910 transmits power to light 900 to energize light 900.

FIG. 9 shows three general storage compartments 810, 820, 830 for storing items such as, for example, money, papers, food, or any other item that can fit in the general storage compartments. The location of general storage compartments 810, 820, 830 in FIG. 9 and of general storage compartment covers 220, 230, 240 in FIG. 1 are exemplary only and are not limiting as to the location of or the number of the general storage compartments.

FIG. 10 is a partial sectional view along section line X-X in FIGS. 2 and 3. This sectional view shows storage compartment 140 being a removable box 1140 that sits in a recess 1142 in handle body 110. Making storage compartment 140 removable can facilitate the placement (or removal) of pills or other items in storage compartment 140. In this example, storage compartment 140 has seven chambers that are separated from each other. Each chamber has a corresponding pressing member 145 that is attached to and urged away from lid 150 by a spring 146. Pressing members 145 press downward on items in the chambers to help prevent movement of the items in the chambers, which can reduce noise such as rattling. FIG. 10 is an example, of a storage compartment 140 that has one row of seven chambers. Other examples have fewer or more chambers located in one or more rows. Removable box 1140 can be replaced by a removable box having only one compartment, or having a plurality of compartments of the same size, or having a plurality of compartments having different sizes. Other inserts can be positioned in recess 1142 such as an additional battery, an electronic device, or other insert.

Figure 11:
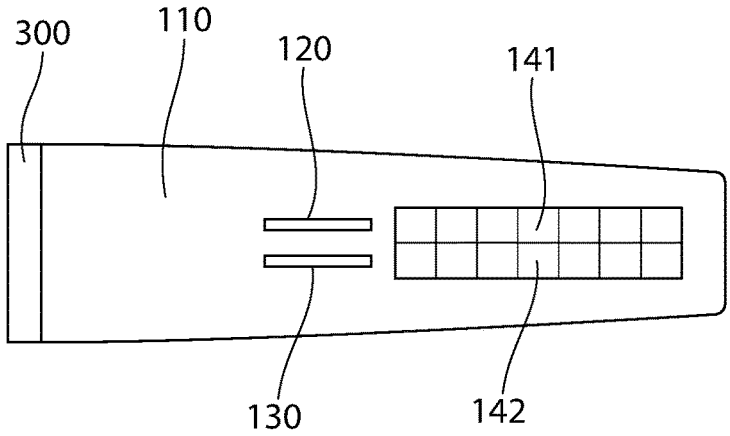
FIG. 11 is a top view of a walking stick in accordance with embodiments of the invention.

FIG. 11 is an example of storage compartment 140 that has two rows 141, 142 of chambers. In this example, each row has seven chambers, one chamber for each day of a calendar week. By providing two rows, two weeks of pills or other items can be stored in walking stick 10.

Figure 12:
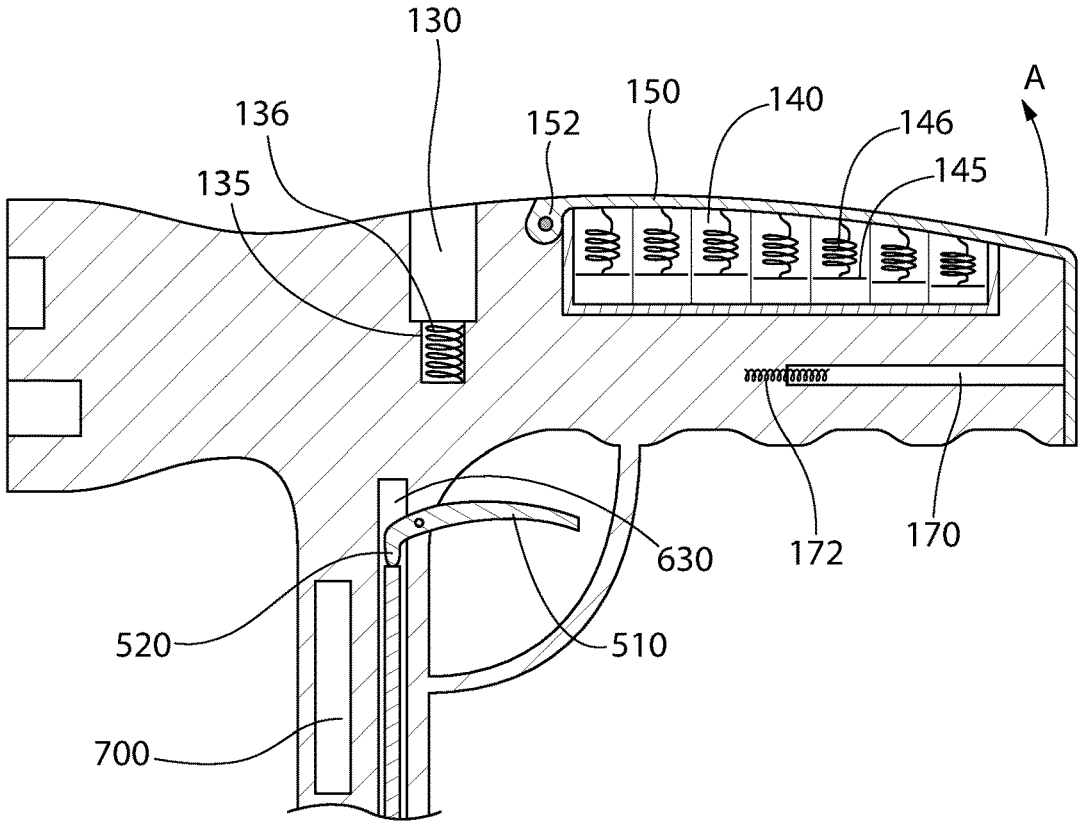
FIG. 12 is an alternate partial sectional view along section line X-X in FIGS. 2 and 3.

FIG. 12 is a partial sectional view of handle 100. This example includes a compartment cover 150 that is attached to handle body 110 by a hinge 152 located near the top of handle body 110 (as opposed to the configuration shown in FIGS. 6, 9 and 10. Compartment cover 150 can be opened by rotating it around hinge 152 in the direction of arrow A. Compartment cover 150 in this example includes back face 160 (FIG. 4) and covers a rear area of handle body 110 when in the closed position. This example includes an I.D. slot 170 that is covered by compartment cover 150 when compartment cover 150 is in the closed position. I.D. slot 170 is configured to house an identification card or other card. I.D. slot 170 has, in this example, a spring 172 that the identification card is pressed against when it is inserted into I.D. slot 170. A locking or latching mechanism that prevents the identification card from exiting I.D. slot 170 until the user is ready to remove the identification card can hold spring 172 in a compressed position until it is released by the user. For example, the locking mechanism can hold spring 172 in a compressed position until the user presses inward on the identification card to move it further into slot 170, at which time the locking mechanism releases spring 172 so that spring 172 pushes the identification card upward and at least partially out of slot 170. Other examples use a latch or blocking mechanism that at least partially slides over the identification card to keep it in I.D. slot 170. In some examples, a recess is formed in compartment cover 150 adjacent to I.D. slot 170 so that the identification card can protrude slightly from I.D. slot 170 when the card is in the stored position. This slight protrusion can facilitate release of the card by making it easier for a user to press the card into I.D. slot 170.

Figure 13:
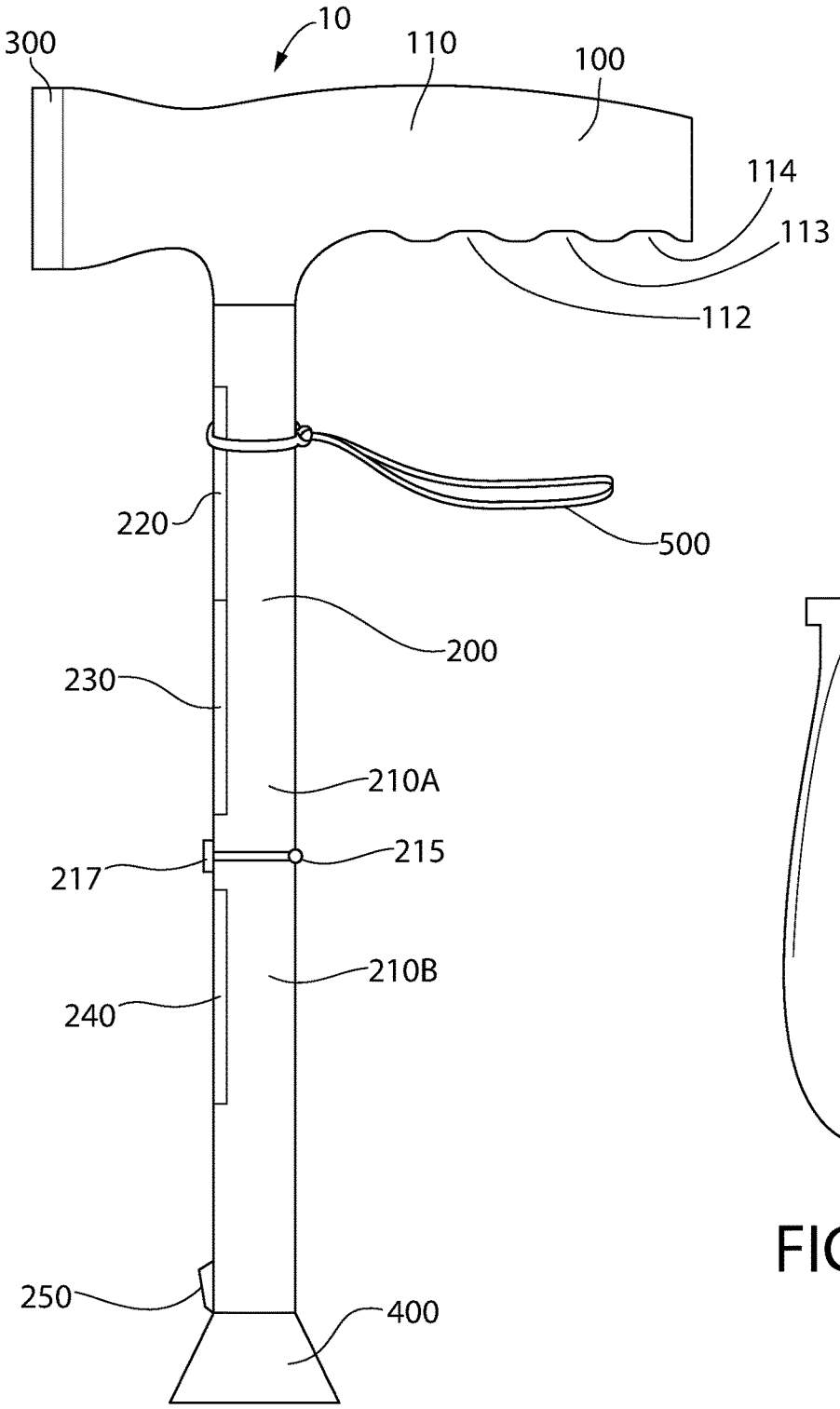
FIG. 13 is a side view of a walking stick in accordance with embodiments of the invention.

FIG. 13 shows an example of walking stick 10 that has a folding shaft body 210. In this example, shaft body 210 is a two-part shaft body having an upper shaft body 210A and a lower shaft body 210B that are connected by a hinge 215. A locking member 217 is provided to ensure that upper shaft body 210A and lower shaft body 210B stay in the aligned position when walking stick 10 is in use. Any form of locking member can be used that can keep hinge 215 from opening when the locking member is in the locked position. For example, a sliding member that engages one or more protrusions can be used as a locking member. By unlocking the locking member, upper shaft body 210A and a lower shaft body 210B can be rotated toward each other to shorten the length of walking stick 10 for storage or carrying. For example, in the folded position, walking stick 10 can more easily fit in luggage or an overhead bin on an airplane.

Figure 14:
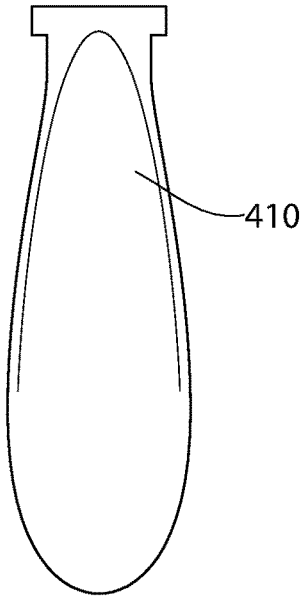
FIG. 14 is a front view of an attachment in accordance with embodiments of the invention.

Walking stick 10 is shown in several of the Figures with a foot 400. Foot 400 can be removable and replaceable. Other implements can be attached to shaft body 210 in the place of foot 400. For example, a shoe horn 410 is shown in FIG. 14. Shoe horn 410 can be attached to the bottom of shaft body 210 (or 210B) to form a long shoe horn that can be used by a user that has, for example, a back problem or another condition that makes bending difficult. While a shoe horn is used as an example, other attachments can also be attached to shaft body 210 (or 210B). For example, foot 400 can be removed and a suction cup or an attachment having a sticky surface can be attached to enable a user to pick up items without having to bend over. A user may have the dexterity to lift the walking stick and change attachments, but not have the ability to bend over or otherwise move to pick up an item that is on the ground, a shelf, or other location.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A walking aid for assisting a user during walking on a surface, the walking aid comprising:

a handle configured to be grasped by a hand of the user;

a surface contacting portion configured to contact the surface on which the user walks;

a shaft having a first end and a second end, the shaft being positioned between the handle at the first end and the surface contacting portion at the second end;

a multi-chamber storage compartment located in the handle, the multi-chamber storage compartment having a plurality of individual chambers that are separated from one another; and a key storage compartment located in the handle, the key storage compartment configured to retain a key to a lock, wherein the key storage compartment includes an urging member and a key-retaining member, the key-retaining member being configured to keep the key in the key storage compartment against an urging force of the urging member.

2. The walking aid of claim 1, wherein the multi-chamber storage compartment has seven of the individual chambers.

3. The walking aid of claim 1, wherein the multi-chamber storage compartment has fourteen of the individual chambers, and the fourteen individual chambers are arranged in two rows of seven chambers per row.

4. The walking aid of claim 3, further comprising an openable lid that is movable between an open position where access to the individual chambers is available and a closed position when access to the individual chambers is not available, wherein each of the individual chambers has associated with it a pressing member and an urging member that urges the pressing member toward an interior space of the individual chamber, and the pressing member and the urging member are attached to the openable lid such that the pressing member and the urging member move with the openable lid.

5. The walking aid of claim 1, further comprising a light source, the light source located in one of the handle and the shaft.

6. The walking aid of claim 5, further comprising a light switch that is configured to be actuated by the user between an on position and an off position, the light source being energized to emit light when the light switch is in the on position.

7. The walking aid of claim 1, further comprising an identification compartment configured to store a user identifying document.

8. The waking aid of claim 7, wherein the user identifying document is an identification card.

9. The walking aid of claim 1, further comprising a light source, the light source located in one of the handle and the shaft;

a light switch that is configured to be actuated by the user between an on position and an off position, the light source being energized to emit light when the light switch is in the on position; and an identification compartment configured to store an identification card, wherein the multi-chamber storage compartment has fourteen of the individual chambers, and the fourteen individual chambers are arranged in two rows of seven chambers per row.

10. The walking aid of claim 9, further comprising a folding joint located in the shaft, the folding joint separating a first portion of the shaft from a second portion of the shaft, the folding joint being movable from a walking position in which longitudinal axes of the first and second portions of the shaft are aligned and a folded position in which the longitudinal axes of the first and second portions of the shaft are not aligned.

11. The walking aid of claim 10, wherein the longitudinal axes of the first and second portions of the shaft are at least approximately parallel in the folded position.

12. The walking aid of claim 1, wherein the second end of the shaft has an attachment feature that engages with an attachment element on the surface contacting portion, and the attachment element of the surface contacting portion is attached to the attachment feature of the shaft such that the attachment element is reattachably removable from the shaft by disengaging the attachment element from the attachment feature.

13. The walking aid of claim 12, wherein the attachment feature of the shaft is configured to engage a plurality of accessories to attach the plurality of accessories to the shaft.

14. The walking aid of claim 13, wherein the plurality of accessories includes a shoe horn.

15. The walking aid of claim 1, further comprising a folding joint located in the shaft, the folding joint separating a first portion of the shaft from a second portion of the shaft, the folding joint being movable from a walking position in which longitudinal axes of the first and second portions of the shaft are aligned and a folded position in which the longitudinal axes of the first and second portions of the shaft are not aligned.

16. The walking aid of claim 15, wherein the longitudinal axes of the first and second portions of the shaft are at least approximately parallel in the folded position.

17. The walking aid of claim 1, further comprising a charging/connection port and a battery, wherein the charging/connection port is electrically connected to the battery.

18. The walking aid of claim 17, wherein the charging/connection port is a USB port.

19. The walking aid of claim 17, wherein the charging/connection port is a phone specific connection port.

20. The walking aid of claim 17, further comprising a second charging/connection port, wherein the second charging/connection port is electrically connected to the battery.

* * * * *